United States Patent [19]

Turnau

[11] Patent Number: 4,935,725

[45] Date of Patent: Jun. 19, 1990

[54] SECURITY DEVICE

[75] Inventor: Peter Turnau, Maple Ridge, Canada

[73] Assignee: British Columbia Telephone Co., Burnaby, Canada

[21] Appl. No.: 381,365

[22] Filed: Jul. 18, 1989

[51] Int. Cl.[5] ..... G08B 13/14

[52] U.S. Cl. ..... 340/568; 340/687

[58] Field of Search ..... 340/568, 571, 650, 652, 340/656, 687, 517, 521, 533

[56] References Cited

U.S. PATENT DOCUMENTS

| | | | |
|---|---|---|---|
| 3,972,039 | 7/1976 | Marshall | 340/280 |
| 4,028,691 | 6/1977 | Zeder | 340/280 |
| 4,075,617 | 2/1978 | Wireman | 340/280 |
| 4,097,843 | 6/1978 | Basile | 340/280 |
| 4,157,542 | 6/1979 | Smith | 340/568 |
| 4,189,723 | 2/1980 | Hylton | 340/568 |
| 4,654,640 | 3/1987 | Carll et al. | 340/568 |
| 4,658,242 | 4/1987 | Zeder | 340/568 |
| 4,688,135 | 8/1987 | Leopold | 340/656 X |
| 4,746,909 | 5/1988 | Israel et al. | 340/568 |

*Primary Examiner*—Joseph A. Orsino
*Assistant Examiner*—Thomas J. Mullen, Jr.
*Attorney, Agent, or Firm*—Shlesinger & Myers

[57] ABSTRACT

A device security system which includes an electrical receptacle having a plurality of outlet locations and a modular socket removably engageable with the outlet locations of the receptacle. With the socket engaged with the receptacle it is adapted to receive a plug. An alarm is coupled to the receptacle and is activated in response to removal of the socket or the plug.

13 Claims, 4 Drawing Sheets

SECURITY DEVICE

BACKGROUND

The present invention relates to security systems for merchandise and electrical appliances and telephones.

A variety of different security devices are available for use with merchandise. One system features a loop which is passed through the article and locked to itself. Cutting or otherwise breaking the loop causes an alarm to be activated. Articles such as electrical appliances or telephones often do not lend themselves to such protection since they seldom have passageways through the device through which a cord or cable could be passed to form a loop restraining removal of the device. Consequently, such devices have alarm units with triggering mechanisms responsive to the removal of the electrical plug or cutting of the cord. However, the limited number of electrical outlets normally available makes displays of merchandise dependent on such outlets inconvenient and of limited flexibility. Moreover, many of these devices require sensing circuits to be installed in the device itself, in the plug outlet or in the plug itself.

U.S. Pat No. 4,157,542 issued to Smith discloses a multiple outlet receptacle assembly into which up to six plugs can be attached. Each receptacle has a moveable spring bias contact which closes upon removal of a plug to cause an alarm to be activated. The concept of a multiple outlet which itself carries a sensing circuitry and can be plugged into a wall outlet does improve the flexibility of merchandise location, but is still limiting. In any event, the Smith device can be defeated by cutting the cable.

Accordingly, there is provided an improved combination merchandise and appliance security system. There is further provided a merchandise or electrical appliance security system which allows advanced flexibility of location. It is a further object of the present invention to provide a security system which becomes activated upon removal of a plug or cutting of the cable.

SUMMARY OF THE INVENTION

According to the invention, there is provided a device security system which includes an electrical receptacle having a plurality of outlet locations. A modular socket is provided which removeably engages with the outlet locations of the receptacle such that when engaged, electrical contacts in the socket are connected to corresponding electrical contacts in the receptacle. The socket is adapted to receive a plug in an electrical and mechanical engagement therewith. Means are provided for activating an alarm in response to removal of the socket from the receptacle, removal of a plug from the socket or cutting the cable with a metal cutter.

Advantageously, the receptacle is elongated and engageable with the socket anywhere along the length thereof.

Preferably the system includes a first shorting means in the socket for shorting the receptacle upon removal of the socket therefrom and a second shorting means in the socket for shorting the receptacle upon removal of a plug from the socket. The receptacle may be an elongated channel with a pair of elongated electrically conductive bands therein.

The form of the receptacle which can be an elongated groove or set of grooves each having a pair of electrically conductive bands therein permits the modular socket to be inserted anywhere along the grooves.

Thus, if the receptacle is affixed to a wall with grooves running along the length of the wall, modular outputs can be located at any height and at any point along the length of the wall thereby considerably enhancing the flexibility of location of the merchandise for display purposes.

BRIEF DESCRIPTION OF THE DRAWINGS

The novel features believed to characterize the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
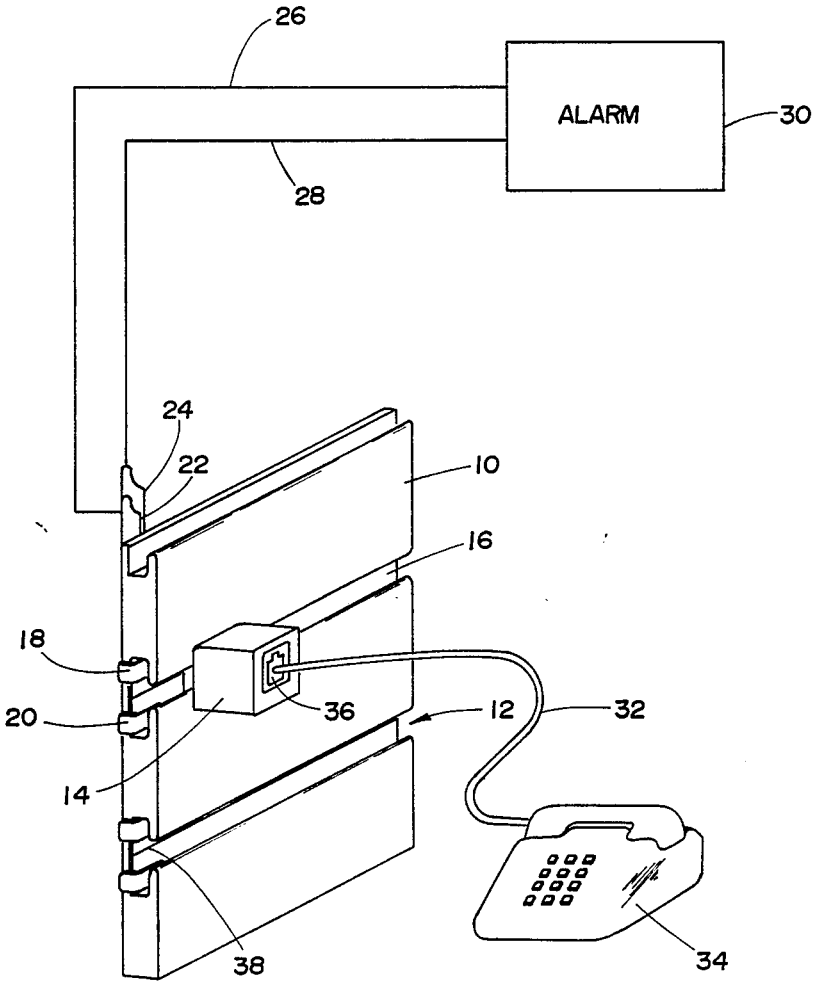
FIG. 1 a perspective view showing the security system with a telephone plugged into the modular socket and the modular socket engaged with one of the plurality of elongated receptacles.

Referring to FIG. 1, there is shown a portion of a panel of slat board 10 which was ordinarily adapted to be placed against a wall with the channels 12 extending horizontally. Within each channel 12 an elongated sheet-like slat 16 having a coating of conductive aluminum along the length thereof with a central groove 38 electrically separating aluminum on one side of the groove 38 from that of the other. The slats 16 are held in place by means of conductive clips 18 and 20 around the ends of each channel 12. The clips 18 and 20 engage vertically extending conductive bands 22 and 24, respectively. Bands 22 and 24 are coupled by means of electrical leads 26 and 28, respectively, to alarm circuit 30. There are any one of a number of known alarm circuits 30 which can be applied for this purpose. A telephone jack plug 36 is shown inserted into the socket of module 14 and is coupled by means of cable 32 to a telephone 34.

Figure 2:
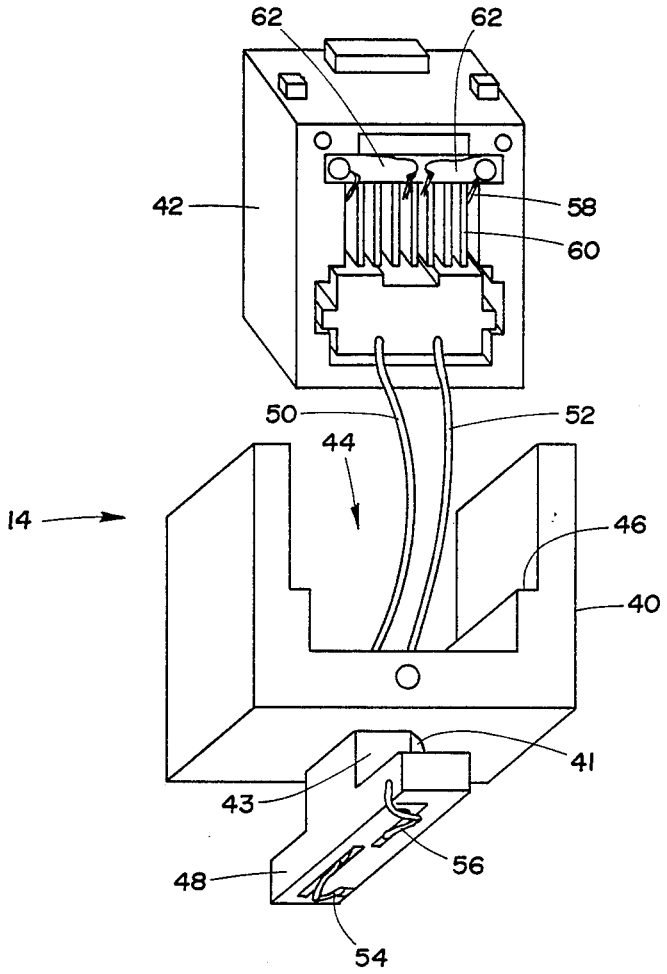
FIG. 2 is perspective view of the modular socket of FIG. 1 with the telephone jack removed from the casing of the module.

Referring to FIG. 2 there is shown the module 14 as consisting of a module casing 40 and telephone jack socket 42. Casing 40 has a open receptacle 44 with a pair of shoulders 46 that are adapted to engage sides of the telephone jack socket 42. A telephone jack socket is coupled by means of electrical leads 50 and 52 to a pair of spring contacts 54 and 56 which extend out the bottom of a wing section 48 of the casing 40. A truncated corner 41 at opposite corners of a narrow abutment 43 allow the socket to be rotated into and out of channels 12 in only in a counter clockwise and a clockwise direction, respectively. Since most people automatically attempt removal by rotation in a counterclockwise direction, many attempts to remove the module 14 will be discontinued by the inability of the module to be rotated in this direction. The electrical leads 50 and 52 also couple to a pair of spring contacts 58 on one side of each of two shorting bars 62. Spring contacts 58 are free to move along the area between associated partitions 60. With no plug inserted, pin springs 58 contact one of the shorting bars 62 and create a short circuit across the spring contacts 54 and 56. Insertion of a jack or telephone plug causes the springs 58 to move away from the shorting bar 62.

Figure 3:
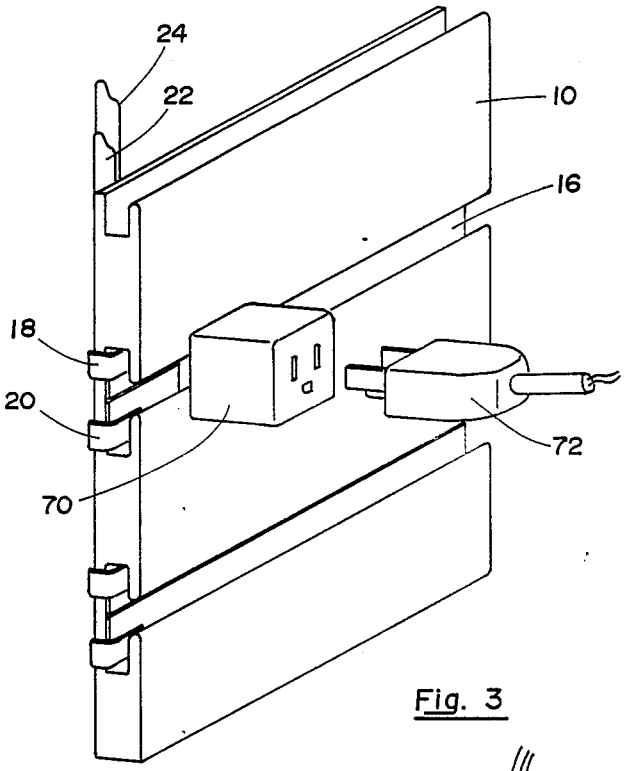
FIG. 3 is a perspective view showing an alternative type of modular socket adapted to receive an ordinary electrical plug.

Referring to FIG. 3 there is shown an alternative module 70 which is adapted to receive an electrical plug 72. In this case vertically extending conducting bands 22 and 24 connect to two of the three wires consisting of the two power wires and the ground wire. The electrical plug 72 is connected by a cable to an electrical appliance such as a lamp, toaster, or television set (not shown).

Figure 4:
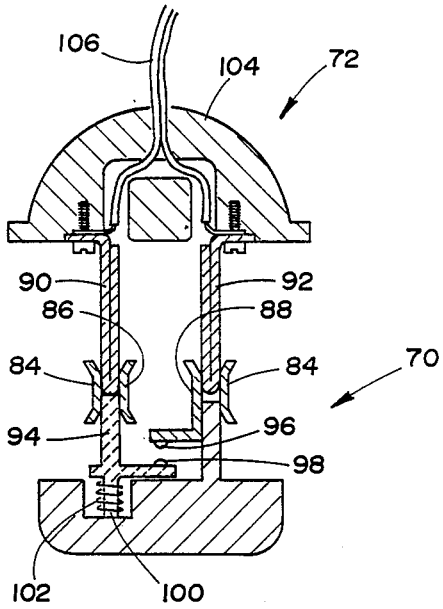
FIG. 4 is a partial sectional view of a plug outlet and plug for a 110 VAC outlet with a spring loaded shorting contact in the plug.

As shown in FIG. 4, module 70 includes terminals 84 and 86 on one side and 84 and 88 on the other Terminal 88 has an extended contact 96 integral therewith. Moveable lever member 94 has a contact 98 which is normally based by spring 102 which fits around rod 100 into contact with contact 96. A plug 72 with plug body 104 and extending contacts 90 and 92 coupled by wire 106 to an electrical appliance (not shown) upon insertion into terminals (84, 86), and (84, 88) depresses lever member 94 breaking the contact between contracts 96 and 98. Removal of plug 72 results in spring 102 urging lever member 94 upwardly causing contacts 96 and 98 to come into contact and short across contacts (84, 86) and (84, 88).

Figure 5:
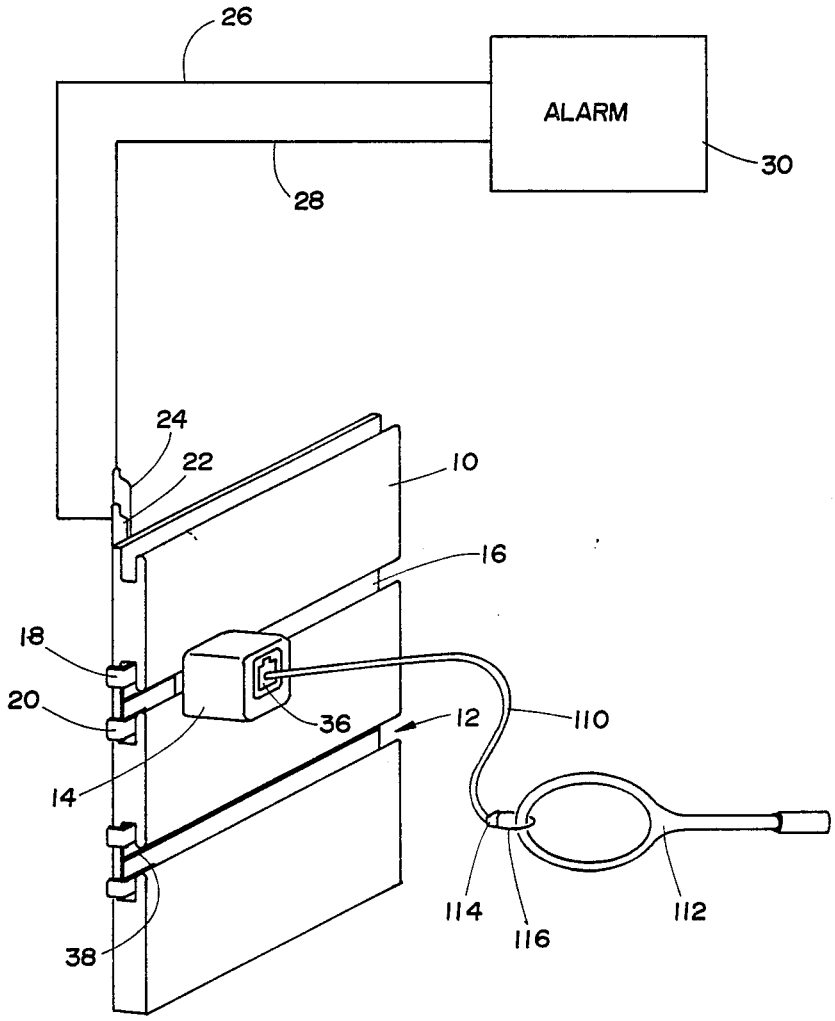
FIG. 5 is a perspective view of the security system used with a tennis racket.

Referring to FIG. 5 there is shown an arrangement similar to that of FIG. 1, in which cable 110 extends from plug 36 to a Tee connection 114. Small wire cable 116 having a pair of conductors connected to a pair of conductors in cable 110, is passed through the head of the tennis racket 112 and affixed to Tee connection 114. Tee connector 114 requires a special key to unlock loop 116. Cutting of the cable with a metal cutter, as well as removal of either plug 36 or module 14 causes a short circuit activating alarm 30.

Ordinarily slat board 10 is placed against the wall of a retail business premises and modules 14 are inserted into position within channels 12 at the desired locations. The plugs 36 are then inserted into the modules 14 and are monitored by electrical lines 26 and 28. In the event removal of the telephone plug 36 is attempted, needles 58 seen in FIG. 2 contact shorting bar 62 and cause an alarm 30 to be activated. Similarly, any attempt to remove the module 14 results in the spring contacts 54 and 56 straddling the groove 38 at a selected location during the rotation of module 14 also causing shorting across leads 26 and 28 and activation of alarm device 30.

Finally, any attempt to cut cable 32 with electrically conductive cutters will place the short circuit across the socket leads 14 and activate alarm 30.

Clearly, cable 30 could have any kind of plug desired and the device or appliance may be powered by the same lines which are used to sense a short circuit It is possible to have a transmitter transmit a signal to a remote receiver with the receiver connected to an alarm 30. In this way the alarm 30 need not be wired directly to the bands 22 and 24.

Since taking a telephone receiver off hook causes a low impedance to be placed across the tip and ring lines, should several telephones be off hook at the same time, an alarm signal could be generated. To avoid this, it is desirable to sense across either the tip and ground lines or the ring and ground lines.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modification or embodiments as fall within the true scope of the invention.

I claim:

1. A device security system, comprising:

(a) an electrical receptacle having a plurality of outlet locations;

(b) a modular socket removably engageable with the outlet locations of said receptacle such that when engaged, electrical contacts in said socket are connected to corresponding electrical contacts in said receptacle, said socket adapted to receive a plug from an external device in removable engagement therewith;

(c) an alarm electromagnetically coupled to said receptacle; and (d) means for activating said alarm in response to removal of said socket from said receptacle, removal of a plug from said socket or shorting across leads of said plug when engaged with said socket.

2. A system according to claim 1, wherein said receptacle is elongated and engageable with said socket anywhere along the length thereof.

3. A system according to claim 2, wherein said receptacle is an elongated channel with a pair of elongated electrically conductive bands therein.

4. A system according to claim 1, including first shorting means in said socket for shorting said receptacle upon removal of said socket therefrom.

5. A system according to claim 1, including second shorting means in said socket for shorting said receptacle upon removal of a plug from said socket.

6. A system according to claim 1, wherein said activating means includes spring loaded contacts in said socket which engage said receptacle and on removal of said socket from said receptacle short across said receptacle.

7. A system according to claim 1, wherein said activating means includes contacts biased towards a position which shorts said receptacle and which are urged away from the shorting position in response to insertion of a plug.

8. A system according to claim 1, wherein said receptacle includes an elongated channel, a pair of electrically conductive bands in said channel, a pair of electrically conductive traversing bands extending from an edge of said channel to a location remote therefrom for attachment to corresponding conductive leads, electrically conductive clips to connect each of said channel bands to corresponding ones of said traversing bands.

9. A system according to claim 8, wherein said channel is widened on both sides below an elongated opening thereto, said bands are elongated aluminum coatings over a thin electrically non-conductive sheet, said coatings electrically separated by an elongated groove and said socket includes a winged section with a pair of spaced apart spring contacts for contacting said bands upon insertion of said winged section into said channel, and said springs short the bands across said groove upon rotation of said winged section so as to engage the widened position of said channel or upon disengagement thereof.

10. A device security system, comprising:

(a) an electrical receptacle having an elongated pair of conductors therein;

(b) a modular socket removably engageable with the conductors of said receptacle at any point along the lengths thereof, said socket adapted to removably, insertably receive a plug in engagement therewith;

(c) an alarm couplable to said receptacle;

(d) a pair of spring contacts on said socket biased against respective ones of said conductors on engagement with said receptacle and positioned to short across said conductors upon removal of said socket from said receptacle; and (e) means for shorting across said conductors upon removal of a plug from said socket;

wherein said alarm becomes activated in response to shorting across said conductors.

11. A system according to claim 10, wherein said receptacle is formed in wall panelling and includes an elongated channel with an elongated opening to said channel of a width narrower than said channel with sides of said channel extending beyond sides of the opening.

12. A system according to claims 11, including an elongated sheet of electrically non-conductive material with an aluminum coating on a face thereof and an elongated groove separating said coating into two elongated conductive bands slidably insertable into said channel against a surface thereof remote from the opening, two conductive strips extending from an edge of said channel to a location remote thereof for connection to external electrical leads, and conductive clips electrically connecting each of said bands to a corresponding one of said strips.

13. A system according to claim 12, wherein said modular socket has an outer winged section joined to a casing of said socket by a short abutment which winged section and abutment are insertable into the opening, rotatable to cause the winged portion to enter said channel and retain said socket in engagement with said receptacle with said springs contacting respective ones of said bands and on removal of said socket by first reversibly rotating said winged section, at least one of said springs shorting said bands.

* * * * *